US005676337A

United States Patent [19]

Giras et al.

[11] Patent Number: 5,676,337

[45] Date of Patent: Oct. 14, 1997

[54] RAILWAY CAR RETARDER SYSTEM

[75] Inventors: Theo C. Giras; Joseph A. Profeta, both of Allegheny County, Pa.; Dario Romano, Salerno, Italy; Joseph P. Elm, Allegheny County, Pa.

[73] Assignee: Union Switch & Signal Inc., Pittsburgh, Pa.

[21] Appl. No.: 369,683

[22] Filed: Jan. 6, 1995

[51] Int. Cl.[6] ..... B61K 7/10

[52] U.S. Cl. ..... 246/182 A; 104/26.2; 104/249; 104/294; 188/62

[58] Field of Search ..... 246/182 A, 182 BH; 104/26.2, 249, 290, 292, 294; 188/34, 35, 62

[56] References Cited

U.S. PATENT DOCUMENTS

| | | | |
|---|---|---|---|
| 3,169,736 | 2/1965 | Brown | 246/182 A |
| 3,200,245 | 8/1965 | Brown | 246/182 A |
| 3,200,246 | 8/1965 | Brockman | 246/182 A |
| 3,209,865 | 10/1965 | Wynn | 188/62 |
| 3,214,581 | 10/1965 | Coley | 246/182 A |
| 3,217,159 | 11/1965 | Auer, Jr. et al. | 246/182 A |
| 3,251,991 | 5/1966 | Coley et al. | 246/182 S |
| 3,253,141 | 5/1966 | Auer, Jr. | 246/182 A |
| 3,253,142 | 5/1966 | Brown | 246/182 A |
| 3,268,725 | 8/1966 | Auer, Jr. et al. | 246/182 A |
| 3,307,031 | 2/1967 | Frielinghaus et al. | 246/4 |
| 3,358,139 | 12/1967 | Smith | 246/182 A |
| 3,770,995 | 11/1973 | Eastham et al. | 104/294 |
| 3,838,646 | 10/1974 | Smith et al. | 104/26.2 |
| 3,844,514 | 10/1974 | DiPaola et al. | 246/182 A |
| 3,865,042 | 2/1975 | DePaola et al. | 104/26.2 |
| 3,874,298 | 4/1975 | Smith et al. | 104/26.2 |
| 4,235,403 | 11/1980 | Gillen et al. | 246/182 A |
| 4,303,870 | 12/1981 | Nakamura et al. | 104/294 |
| 4,610,206 | 9/1986 | Kubala et al. | 104/26.2 |
| 4,721,045 | 1/1988 | Okawa et al. | 104/290 |
| 4,800,818 | 1/1989 | Kawaguchi et al. | 104/290 |
| 4,867,279 | 9/1989 | Link et al. | 188/62 |
| 5,215,015 | 6/1993 | Iida et al. | 104/284 |

*Primary Examiner*—S. Joseph Morano
*Attorney, Agent, or Firm*—Buchanan Ingersoll, P.C.

[57] ABSTRACT

A railway car retarder mechanism that employs linear electromagnetic induction to precisely accelerate or decelerate a railcar. The retarder mechanism includes a plurality of linear induction stators having a spaced plurality of primary inductors, a controllable power source electrically connected with selected ones of the primary inductors, a controller for controlling the electric current transmitted to the respective primary inductors by the controllable power source, and a sensor for sensing selected railcar parameters and transmitting those parameters to the controller, so that the speed-corrective forces applied by the retarder are proportional to these parameters. The controller regulates the magnetomotive force which is imparted upon a selected one of a plurality of railcar wheel sets, and is connected with each controllable power source. In some embodiments, the sensor include at least a portion of fiber-optic cable, which cable can be disposed proximate to a predetermined length of track rail.

38 Claims, 8 Drawing Sheets

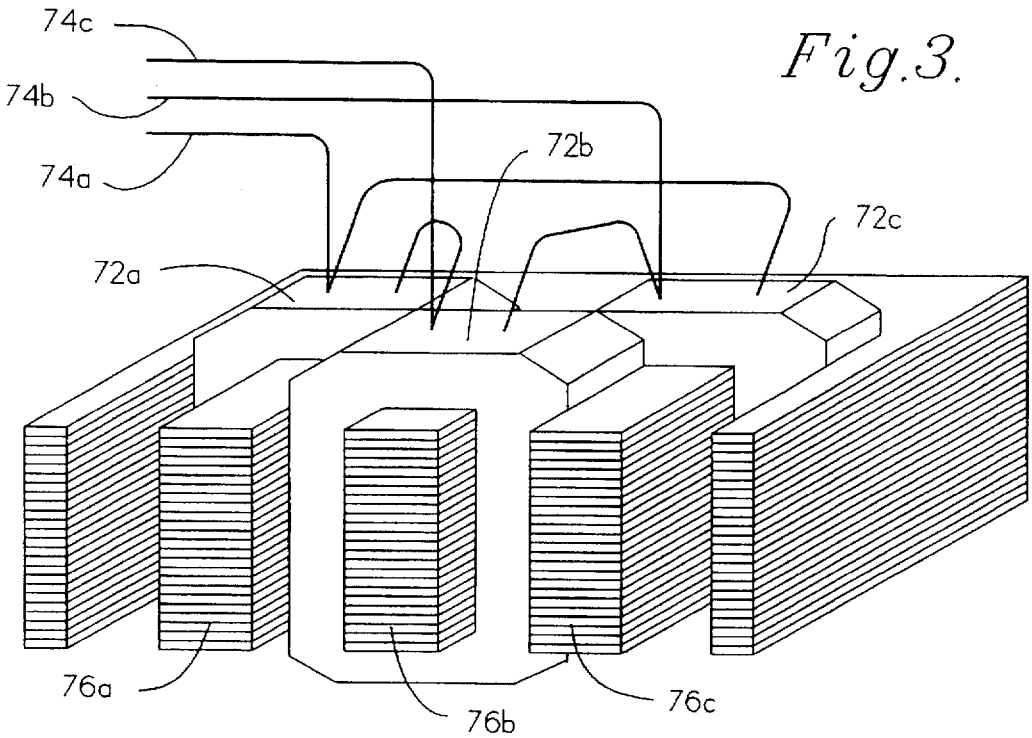
Fig.3.
Fig.4a.
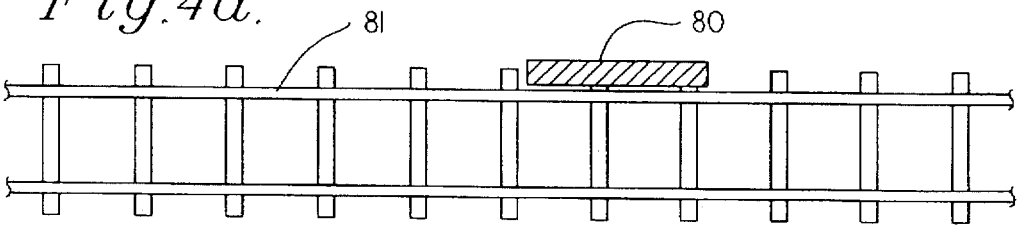
Fig.4b.
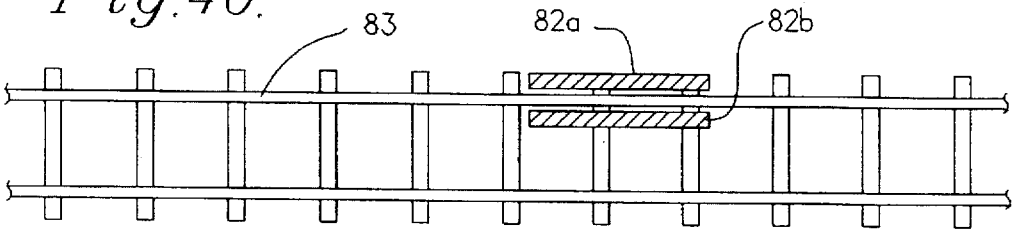
Fig.4c.
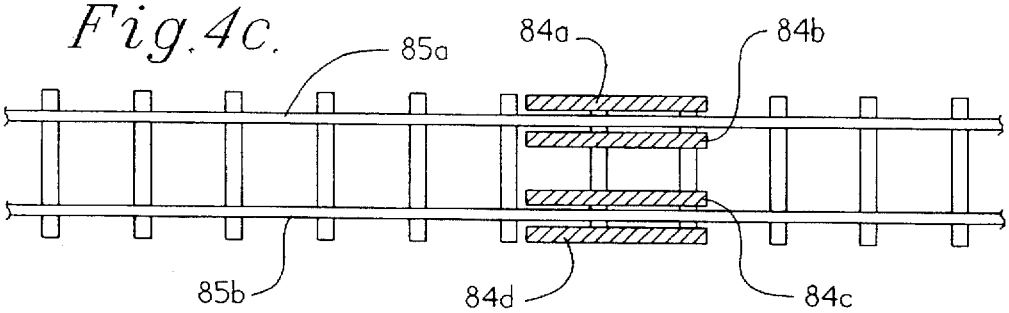

RAILWAY CAR RETARDER SYSTEM

BACKGROUND OF THE INVENTION

1. Field of the Invention

The present invention relates to railway braking apparatus, particularly railroad car retarders, and more particularly to railroad car retarders employing linear induction motors to provide precise braking or accelerating of rail vehicles under the control of the retarders.

2. Description of the Art

Operational goals place a strong demand on the ability to increase the throughput capacity of railcar classification (or marshalling) yards. Current technology may not always provide either maximum throughput or precise coupling speeds. The result can be delays and increases in the costs of shipping goods. The mechanization and automation of railcar classification yards are important factors in the modernization of goods transportation systems.

At present, the control of a railcar speed is obtained by mechanical, electrical, or pneumatic car retarders that reduce the kinetic energy of the car. These types of systems may not always accurately control railcar speed and in some cases can result in damage to freight cars when coupling speeds are too high. The speeds of cars vary materially because of different car weights, the cars being hard- or easy-to-roll, windage, the curvature of the track, etc. Also, variations in friction can make the retarding forces of some mechanical systems unpredictable.

The operation of a railroad classification yard is as follows. A railcar is pushed over an artificial hill in the classification yard, called the "hump", to provide the railcar with sufficient velocity to traverse the expanse of the yard. In such a system, the crest of a hump must be high enough for the hardest-to-roll and lightest car to be classified to coast to the most distant destination for such a car in the classification yard. After gaining velocity by passing over the hump, railcar speed is regulated by one or more retarders. The retarder itself is usually a set of powerful jaws on each side of and a few inches above the railhead which grasp the car wheels, thereby slowing the car to the desired exit speed. To suppress the squeal of the railway car retarder arising from the action of the retarder against the wheels of the railway car, noise suppression systems can spray the wheels of the railway car with an oil-in-water emulsion as a car passes through the retarder; such operations may be restricted by environmental standards.

Initially, railcar velocity is decreased by the main retarder, based on the measured velocity and the destination of the railcar. Next, the car is switched onto a preselected one of several group tracks, passing through the group retarders, where it is again slowed if the railcar's velocity and destination so dictate. Finally, the railcar is switched onto one of several tangent tracks associated with a particular group track, where the railcar passes a tangent retarder. The tangent retarders are generally at the end of the classification yard, and may have the last chance to control the terminal velocity of the vehicle. The velocity of the railcar is decreased by the tangent retarder such that the terminal velocity upon coupling is less than a predetermined maximum speed such as, for example, four miles per hour.

This desired operation is not always achieved because the terminal velocity typically varies with railcar weight, windage, frictional forces, and the varying space available on the track. Typically, the velocity of the railcar can be measured with a doppler radar system. These radar systems may not be sufficiently accurate to precisely regulate the terminal velocity. At times, railcar velocity may be lower than that necessary to effect proper coupling, thereby requiring trimming operations by one or more trimmer engines.

Although earlier studies with linear motors indicated that it might be feasible to obtain acceleration and deceleration with the same retarder, at present there are no commercial railcar retarders which employ linear induction motors to precisely regulate railcar speed. What is needed, therefore, is a railcar retarder using linear induction motors that can accelerate and decelerate a railcar with precise control and less noise than current railcar retarder systems.

SUMMARY OF THE INVENTION

The invention provides for a railway car retarder mechanism that employs linear electromagnetic induction to precisely accelerate or decelerate a railcar. The retarder mechanism includes a plurality of linear induction stators having a spaced plurality of primary inductors, a controllable power source electrically connected with selected ones of the primary inductors, a controller for controlling the electric current transmitted to the respective primary inductors by the controllable power source, and a sensor for sensing selected railcar parameters and transmitting those parameters to the controller, so that the speed-corrective forces applied by the retarder are proportional to these parameters. The controller regulates the magnetomotive force which is imparted upon a selected one of a plurality of railcar wheel sets, and is connected with each controllable power source. In some embodiments, the sensor include at least a portion of fiber-optic cable, which cable can be disposed proximate to a predetermined length of track rail.

Respective pairs of the primary inductors may have at least a portion of track rail disposed between them. In one embodiment, pole faces of respective ones of plurality of primary inductors are oriented generally perpendicularly to the direction of, and in confronting relation with, a track rail. In this embodiment, at least a portion of the track rail generally can be disposed between the respective pole faces.

In another embodiment, respective ones of the primary inductors are magnetically linked by at least a portion of a magnetically permeable substrate to respective other primary inductors. The track rail is disposed generally above the plurality of primary inductors and the substrate, and is magnetically linked to at least a portion of the substrate. In this embodiment, the track rail can have a plurality of magnetic track sections and a plurality of non-magnetic track sections, with respective ones of the plurality of non-magnetic track sections being interposed between respective ones of the plurality of magnetic track sections. In this embodiment, the non-magnetic track sections can be disposed above the primary inductors, and the magnetic track sections can be disposed generally above the substrate.

In some embodiments, the controllable power source includes a power multiplexer which is connected with at least one linear induction stator and a power converter which is interposed between an AC power source and the power multiplexer. Where AC current supplies the power for the car retarder mechanism, a power converter may be used, which can be a regenerative AC-to-AC power converter.

Electric power to the car retarder mechanism also may be supplied by a commercial AC power source through a DC power supply. In this embodiment, the DC power supply can be a regenerative power supply. Some embodiments include a DC power supply having a power multiplexer which is connected with a plurality of linear induction stators, and a power converter connected between the DC power supply and the power multiplexer.

Means for cooling the primary inductors may also be included in the car retarder mechanism. The cooling may be accomplished by a fluid such as, for example, air, water, oil, alcohol, or a compressed gas.

BRIEF DESCRIPTION OF THE DRAWINGS

FIG. 3 is an illustration of one embodiment of a linear induction stator according to the invention herein.

FIG. 4*a* is an illustration of one linear induction stator in a side-line configuration.

FIG. 4*b* is an illustration of two linear induction stators in a side-line configuration.

FIG. 4*c* is an illustration of four linear induction stators in a side-line configuration.

DETAILED DESCRIPTION OF THE EMBODIMENTS

Figure 1:
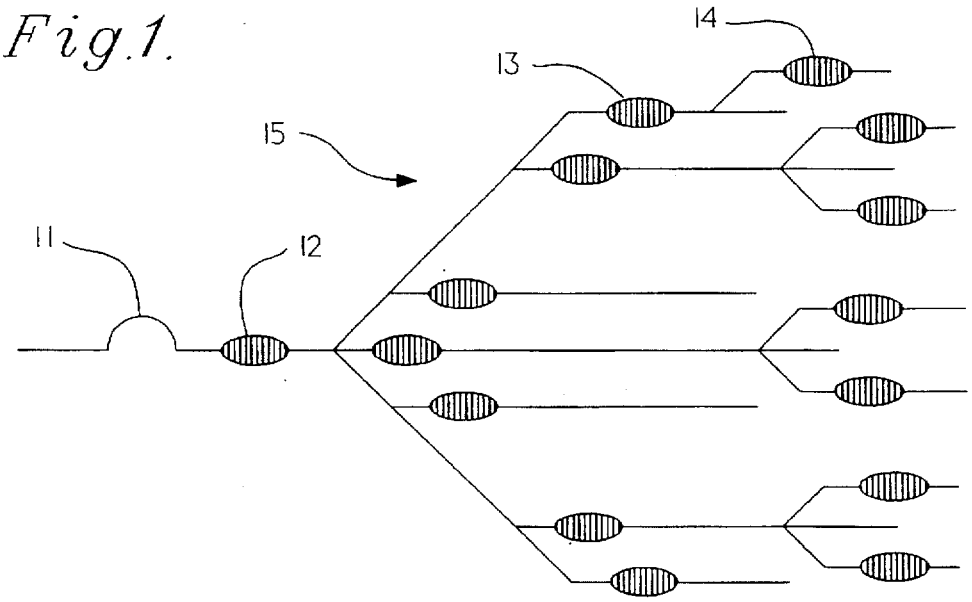
FIG. 1 is an illustration of a railcar classification yard.

The typical classification yard operation as depicted in FIG. 1 is as follows. Railcars which are to be sorted are pushed by a hump locomotive over hump 11, or artificial hill. Gravity then moves the railcars into classification yard 15. Depending upon the railcar's measured velocity and intended destination, the railcar may be slowed by main retarder 12. The railcar is then directed to a desired group track where the railcar may be further slowed by group retarder 13, as the railcar's measured velocity and destination dictate. Finally, the railcar is switched into tangent tracks where tangent retarders 14 act to decrease the terminal velocity of the railcar upon coupling to an acceptable speed such as, for example, less than four miles per hour. However, this typical operation is not always achieved because the terminal velocity cannot always be accurately regulated. Variances in weight, windage, frictional forces, and space available on the track, all serve to vary railcar velocity from the desired value. At times, railcars lacking the proper terminal velocity can stall or incompletely couple, thereby requiring trimming by one or more trimming locomotives. The trimming process is slow, and consequently expensive, and can damage the goods aboard the railcar. On the other hand, insufficient retarding of the railcar's speed can cause coupling to be effected at greater-than-desired speed thereby damaging the couplings, and, frequently, the railcar load.

The invention herein provides a linear induction railway car retarder mechanism which can precisely regulate the speed of a railcar by imparting an accelerating or retarding magnetomotive force to selected wheel sets of the railcar. The magnetomotive force is generated by applying an electric current of a preselected voltage and frequency to at least one linear induction stator. Each stator has a plurality of primary inductors. Electric current can be applied to each primary inductor in a predetermined sequence by a preferred method so that the magnetomotive force can be imposed in the desired direction.

Each linear induction stator can be supplied by a variable-voltage, variable-frequency (VVVF) solid-state power converter with microprocessor control in order to achieve the proper thrust or retardation for varying railcar speeds, by providing the desired voltage and frequency to the retarder mechanism. The converter supply frequency can utilize parameters such as train speed, which can be measured and transmitted to the converter frequency regulator in real time. Commercial AC power sources typically supply a fixed-frequency, fixed-voltage electric power. Direct application of such power to linear induction stators would not produce precise speed control of railcars using the retarder. Therefore, each linear induction stator can be supplied by a VVVF power converter. Although each linear induction stator may be supplied by a dedicated power converter, controller and sensor, it may be preferable that multiple stators be supplied electrical power using a multiplexed power conversion and distribution system. Power multiplexing may involve a coordination with the central yard facility that routes the railcars such that power can be supplied to a retarder at the estimated time of arrival of a railcar.

When used to accelerate a railcar, the power converter translates the electrical energy from the power system into kinetic energy which is imparted to the vehicle via the wheel set. When the power converter is used in a retarding mode, a portion of the railcar's kinetic energy is converted into electrical energy, which energy is then returned to the power system. The power converters may be supplied by either an AC or a DC power distribution system. Where the power supplied to the retarder is derived directly from an AC power source, it may be preferable to provide a regenerative AC-to-AC VVVF converter between the AC power bus and the retarder. Where the retarder is supplied by a DC power distribution bus, which DC bus may ultimately receive power from a commercial AC power system, the AC power from the power system can be converted to DC by way of a regenerative DC supply. Further, the DC power can be converted to AC for retarder use by employing a regenerative DC-to-AC VVVF converter.

Other details, objects, and advantages of the invention will become apparent as the following descriptions of present preferred embodiments thereof proceeds, as shown in the accompanying drawings.

Figure 2:
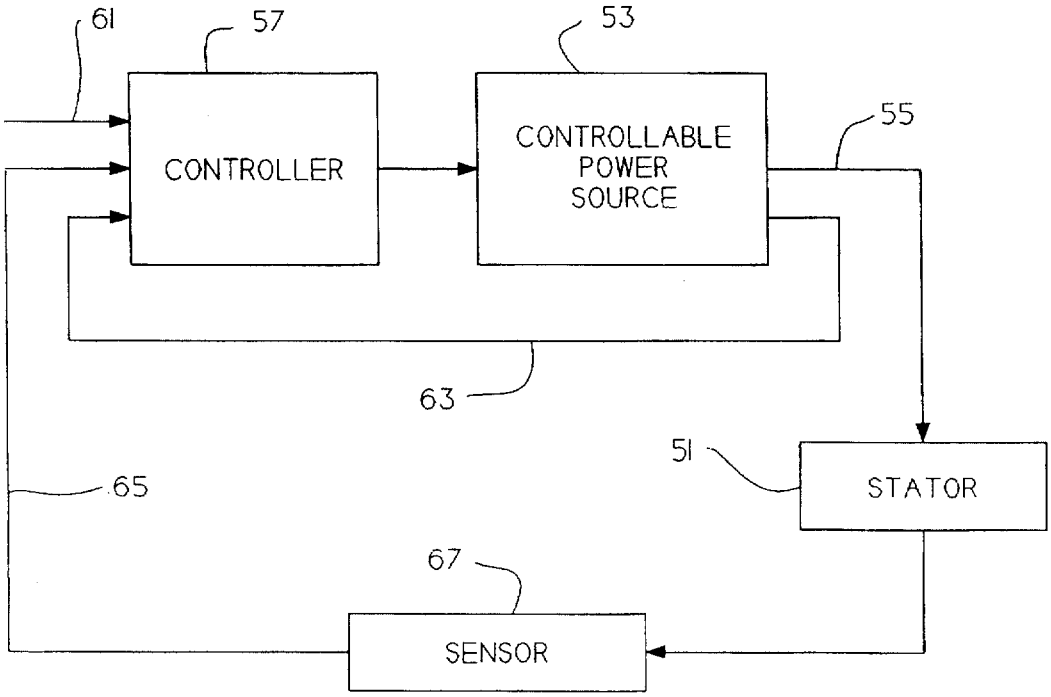
FIG. 2 is a diagram of a linear induction retarder mechanism according to the invention herein.

In one embodiment shown in FIG. 2, a plurality of linear induction stators, such as stator 51, is supplied electrical power by a controllable power source 53. The magnitude and polarity of current 55 supplied to stator 51 through power source 53 determines the magnitude and orientation of the magnetomotive force applied to the railcar wheels. Controller 57 controls electric current 55 by selective operation of power source 53. Sensor 67 senses selected railcar parameters and conveys this information to controller 57. Controller 57 is responsive to at least one of remote signal 61, power source feedback signal 63, and selected railcar parameter signal 65 which is provided by sensor 67. Remote signal 61 may be provided by railyard sources such as, for example, a central yard facility.

The linear induction stator herein can employ a plurality of primary inductors. Selected railcar wheels are used as secondary reaction elements, thereby forming a linear induction motor. The primary inductors may be oriented such that the electromagnetic field generated by the primary inductors is oriented either generally perpendicular to, or substantially coplanar with, the railcar wheel diameter.

Turning to the embodiment illustrated in FIG. 3, linear induction stator 70 is illustrated with three primary inductor coils 72*a*, 72*b*, 72*c*—one inductor per phase line 74*a*, 74*b*, 74*c*. Although three-phase power can be supplied to stator 70, other power modalities may be desired. In general, stator 70 and primary inductor coils 72*a*, 72*b*, 72*c* can be disposed generally proximate to, and parallel with, the track rails. In this configuration, pole faces 76*a*, 76*b*, 76*c* are oriented generally perpendicularly to the longitudinal axis of the track rails, thereby placing pole faces 76*a*, 76*b*, 76*c* in confronting relation with the track rails. This configuration is designated "side-line", and shown generally in FIGS. 4*a*, 4*b* and 4*c*.

Multiple linear induction stators may be used to achieve the desired result. For example, in one embodiment of the sideline configuration shown in FIG. 4*a*, a single linear induction stator 80 may be oriented parallel to one rail of railroad tracks 81. Stator 80 can be disposed on one lateral side of a railcar wheel, so that electromagnetic energy may be imparted to or withdrawn from the respective wheelset thereby accelerating or retarding railway car speed. In another embodiment of the sideline configuration shown in FIG. 4*b*, two linear inductor stators 82*a*, 82*b*, one on each lateral side of single track rail 83, can be used together to increase the acceleration or retardation effects on the railcar wheel sets. In this embodiment, one stator 82*a* may be situated generally opposite the other stator 82*b*, with a section 83 of railroad track passing therebetween. In this configuration, stators 82*a*, 82*b* are disposed on both lateral sides of a particular passing wheel. In yet another embodiment employing the side-line configuration, shown in FIG. 4*c*, four linear induction stators 84*a*, 84*b*, 84*c*, 84*d* may be used to provide an acceleration or retardation force that is generally uniform across both wheels of a particular wheel set. In this embodiment, one linear induction stator 84*a*, 84*b*, 84*c*, 84*d* can be situated on each lateral side of each track rail 85*a*, 85*b*, and thus to each lateral side of both wheels of a wheelset. In general, the linear induction stators are oriented along an axis which is parallel to the direction of the track rails.

Figure 5:
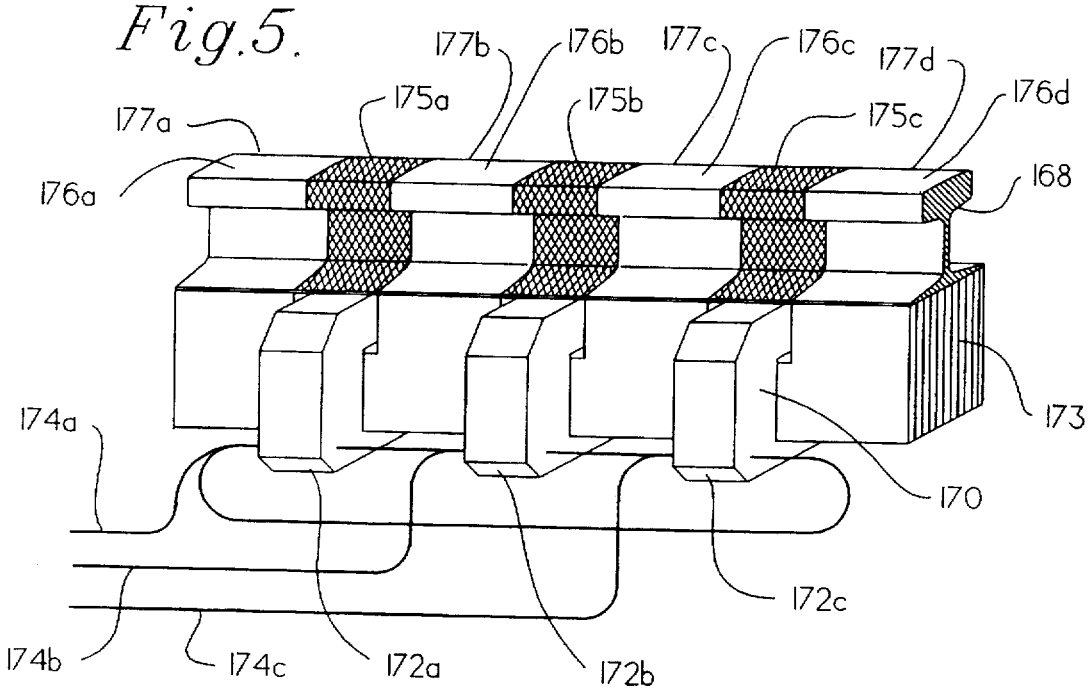
FIG. 5 is an illustration of a second embodiment of a linear induction stator according to the invention herein.

In another embodiment shown in FIG. 5, rail 168 lies above stator 170, and that the magnetic flux generated by primary inductor coils 172*a*, 172*b*, 172*c* be generally coplanar with rail 168, and thus, coplanar with the diameter of a railcar wheel. This configuration is designated "in-line".

It is also shown that primary inductor coils 172*a*, 172*b*, 172*c* surround at least a part of magnetically permeable substrate 173, which substrate 173 is disposed proximately to and below, and is magnetically linked to, rail 168. Rail 168 can be made of a plurality of non-magnetic track sections 175*a*, 175*b*, 175*c*, respective ones of which are interposed between respective ones of a plurality of magnetic track sections 177*a*, 177*b*, 177*c*, 177*d*. The magnetically permeable substrate 173 permits the magnetic fields generated by primary inductor coils 172*a*, 172*b* and 172*c* to be redirected into magnetic track sections 177*a*, 177*b*, 177*c*, 177*d*. In the embodiment shown in FIG. 5, magnetic track section 177*a* corresponds to pole face "A", 176*a*, 176*d*, magnetic track section 177*b* corresponds to pole face "B", 176*b*, and magnetic track section 177*c* corresponds to pole face "C", 176*c*. Pole faces A, B, and C correspond to phase line A, 174*a*, phase line B, 174*b* and phase line C, 174*c*, respectively.

Figure 6A:
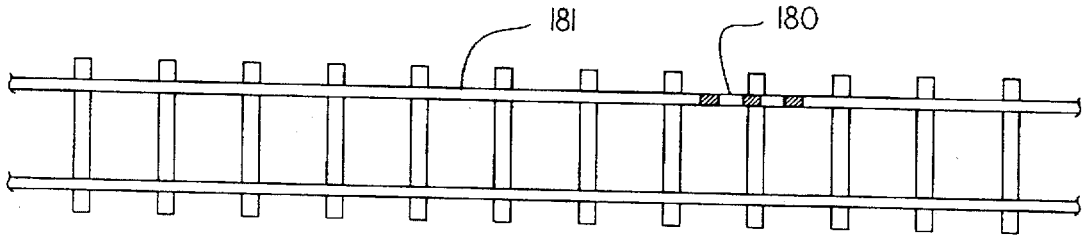
FIG. 6*a* is an illustration of one linear induction stator in a in-line configuration.
Figure 6B:
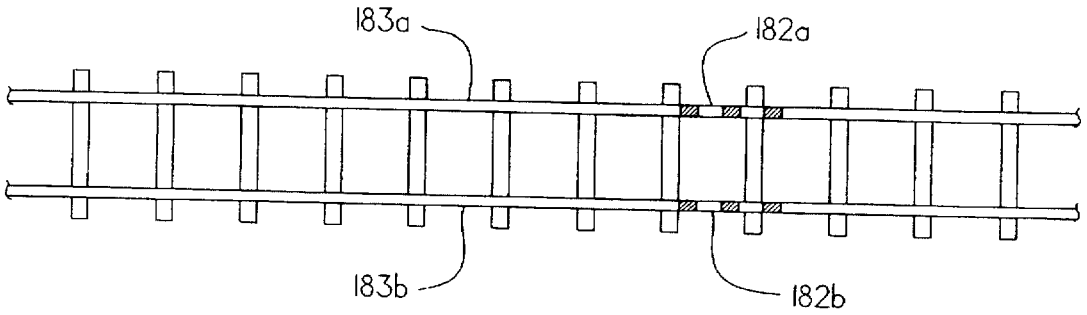
FIG. 6*b* is an illustration of two linear induction stators in a in-line configuration.

As with the side-line configurations in FIGS. 4*a*, 4*b* and 4*c*, single or multiple linear induction stators may be used with the in-line configuration. For example, the retarder may consist of single linear induction stator 180 in-line with a single track rail 181 as shown in FIG. 6*a*. Although multiple linear induction stators using the in-line configuration may be employed on a single track rail, the linear induction stators 182*a*, 182*b* can be used on each of two adjacent track rail sections 183*a*, 183*b* shown in FIG. 6*b*.

Figure 7:
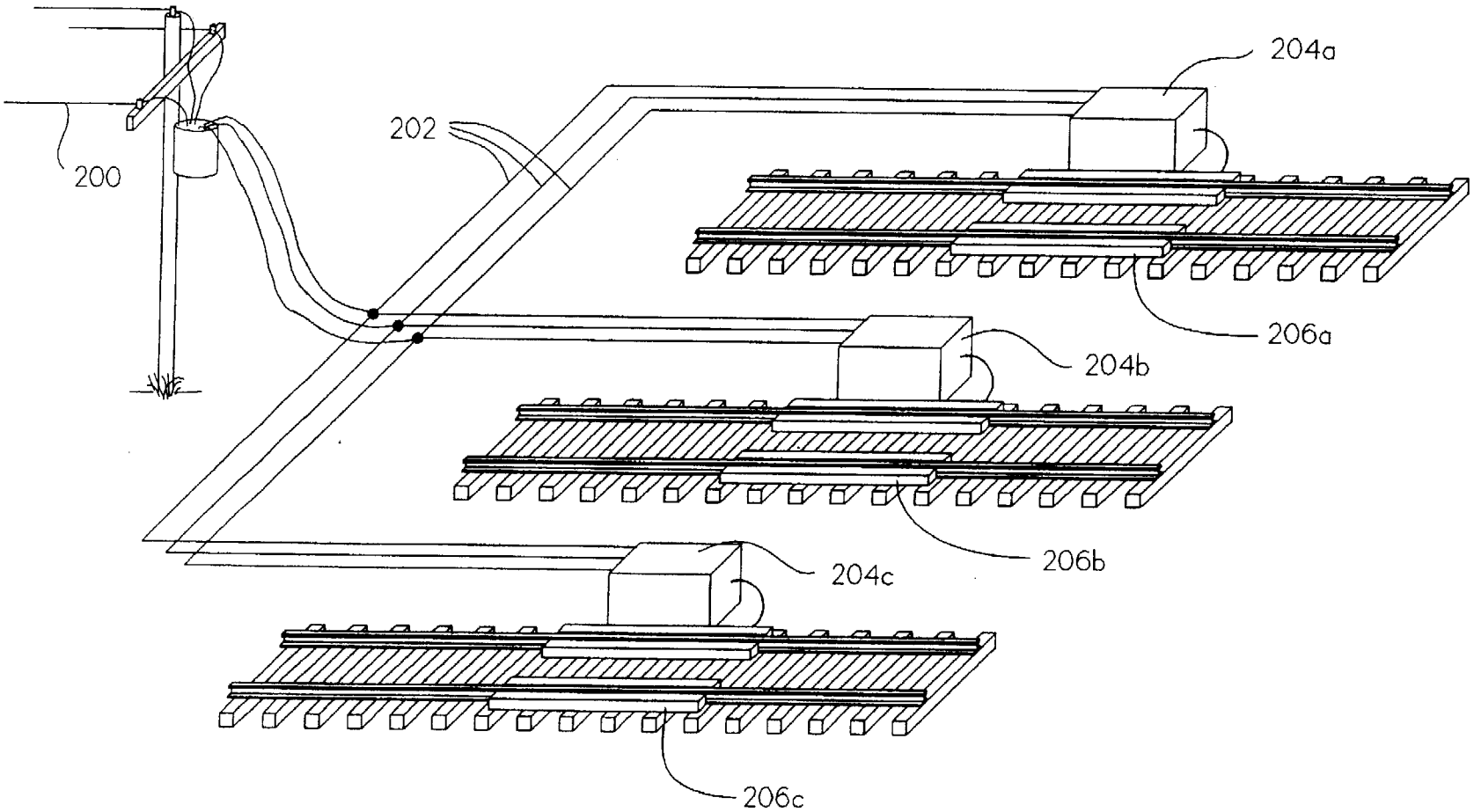
FIG. 7 is an illustration of an AC power distribution system providing electric power to linear induction retarder mechanisms through AC-to-AC power converters.

FIG. 7 depicts AC power distribution to linear induction retarder mechanisms. Electric power can be drawn from commercial three-phase AC power system 200 and distributed to each of power converters 204*a*, 204*b* and 204*c* by way of AC bus 202. Power converters 204*a*, 204*b* and 204*c* translate the fixed voltage, fixed-frequency power from AC power source 200 into variable-voltage, variable-frequency AC power that is operationally required by linear induction stators 206*a*, 206*b*, 206*c*. Power converters 204*a*, 204*b*, 204*c* may employ a regenerative AC-to-AC VVVF converter.

Figure 8:
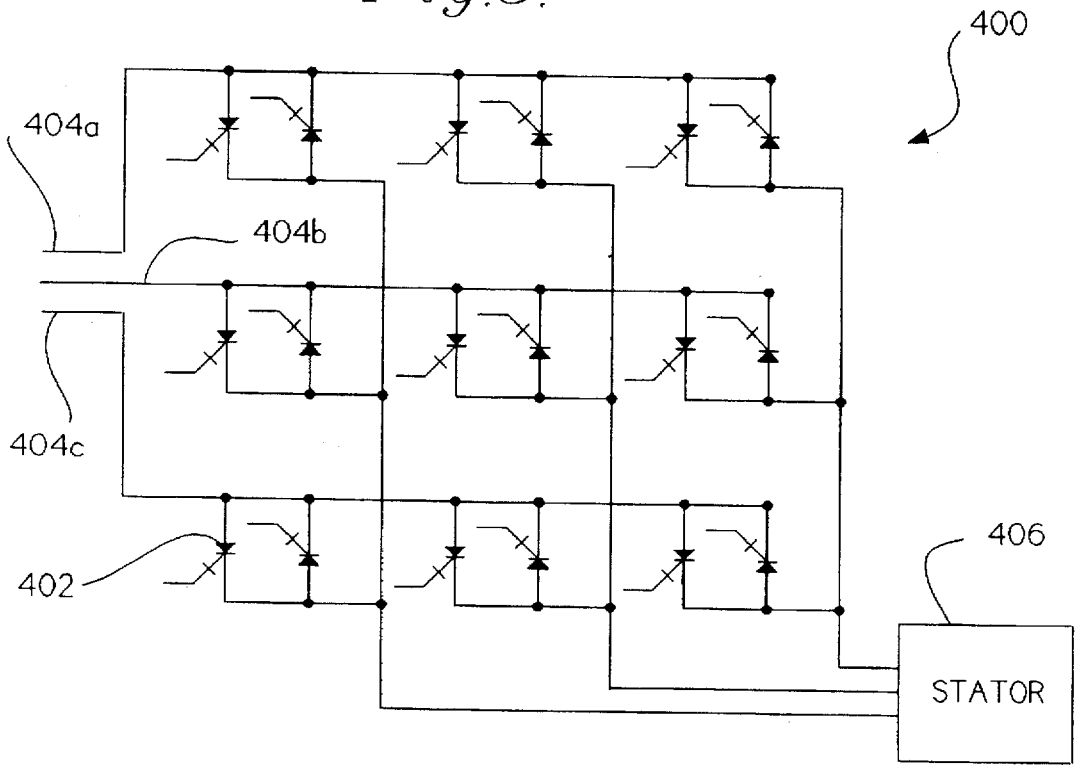
FIG. 8 is a diagram of one embodiment of a regenerative AC-to-AC power converter.

One embodiment of regenerative AC-to-AC converter 400 is shown in FIG. 8. Power can be bidirectionally supplied by a matrix of complimentary semiconductor switches 402 such as, for example, gate turn-off thyristors (GTOs) or IGBTs. By utilizing switches 402 with active turn-off capabilities, converter 400 can be used to "chop" the input AC waveforms applied on input lines 404*a*, 404*b*, 404*c* to create frequencies higher than the source of frequency. The desired voltage may be delivered to stator 406 at the desired frequency by controlling the gates of the semiconductor switches 402 according to a predetermined method. When a railcar is decelerated, power is returned from stator 406 to the AC-to-AC converter 400 where power is returned to the AC power source in a fixed frequency, fixed voltage format by way of input lines 404*a*, 404*b*, 404*c*.

Figure 9:
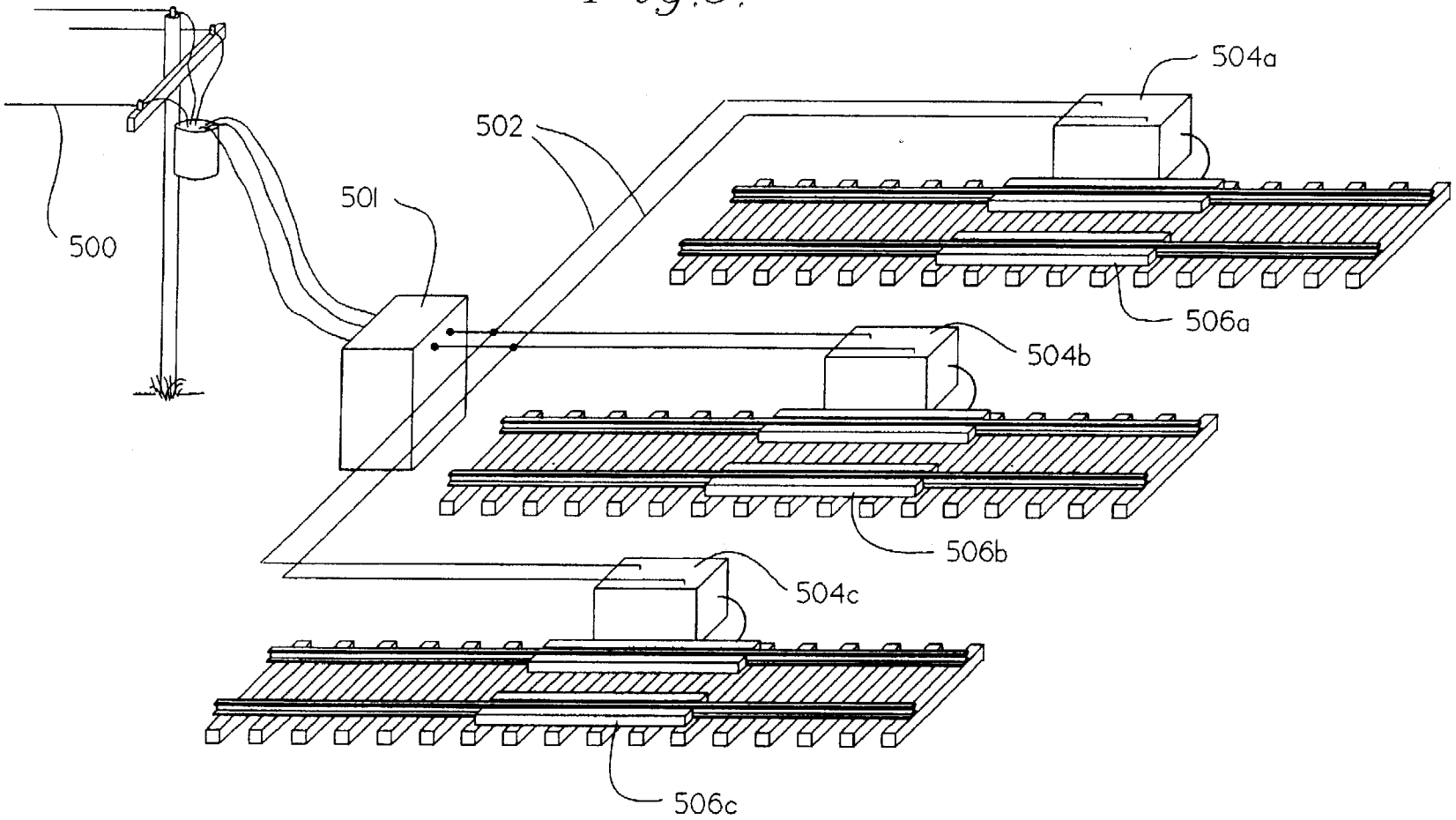
FIG. 9 is an illustration of an DC power distribution system providing electric power to linear induction retarder mechanisms through DC-to-AC power converters.

FIG. 9 depicts DC power distribution to linear induction retarder mechanisms. Electric power can be drawn from commercial three-phase AC power source 500 into AC-to-DC converter 501, which can be a regenerative AC-to-DC converter. DC power can be distributed to each of power converters 504*a*, 504*b*, 504*c* by way of DC bus 502. Power converters 504*a*, 504*b*, 504*c* translate the fixed-voltage DC from DC power bus 502 into variable-voltage, variable-frequency AC power that is operationally required by linear induction stators 506*a*, 506*b*, 506*c*. Power converters 504*a*, 504*b*, 504*c* may employ a regenerative DC-to-DC converter.

Figure 10:
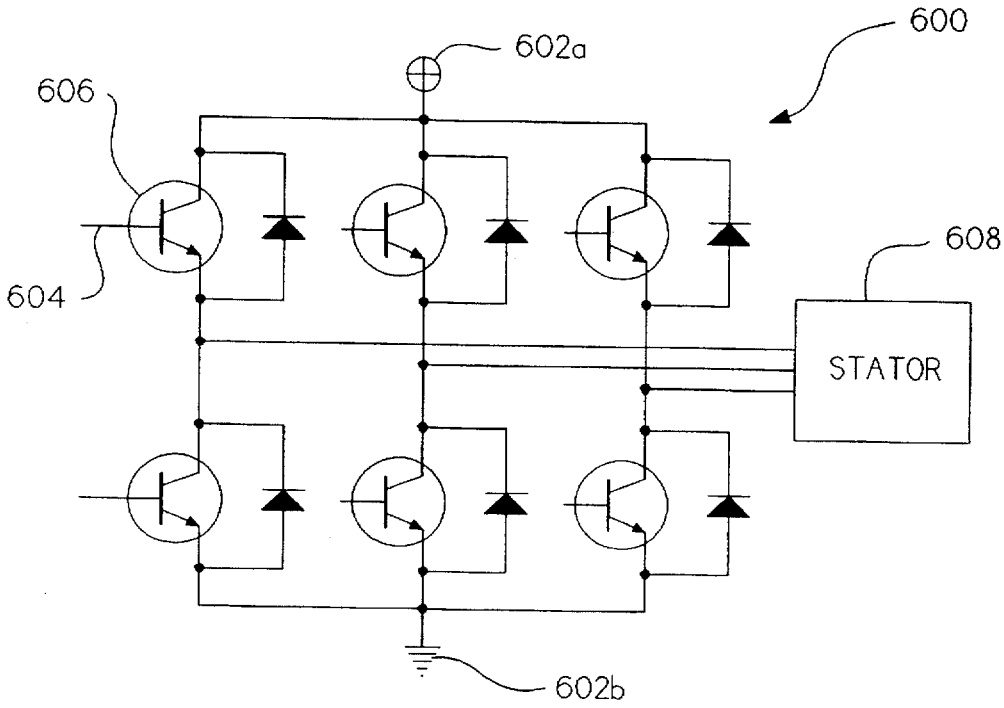
FIG. 10 is a diagram of one embodiment of a regenerative DC-to-AC power converter.

In FIG. 10, a DC-to-AC converter is shown. Direct current is supplied to converter 600 at a fixed voltage from bus input lines 602*a*, 602*b*. By selectively operating gates 604 of semiconductor switches 606, the DC current can be "chopped" to a variable-voltage, variable-frequency AC power to stator 608. Suitable control of semiconductor switches 606 can be provided by a preferred method such as, for example, pulse-width modulation (PWM) techniques. While a variable-voltage, variable-frequency power supply format can be used for the retarder mechanisms herein, a variable-voltage, fixed-frequency power format may also be used.

Figure 11:
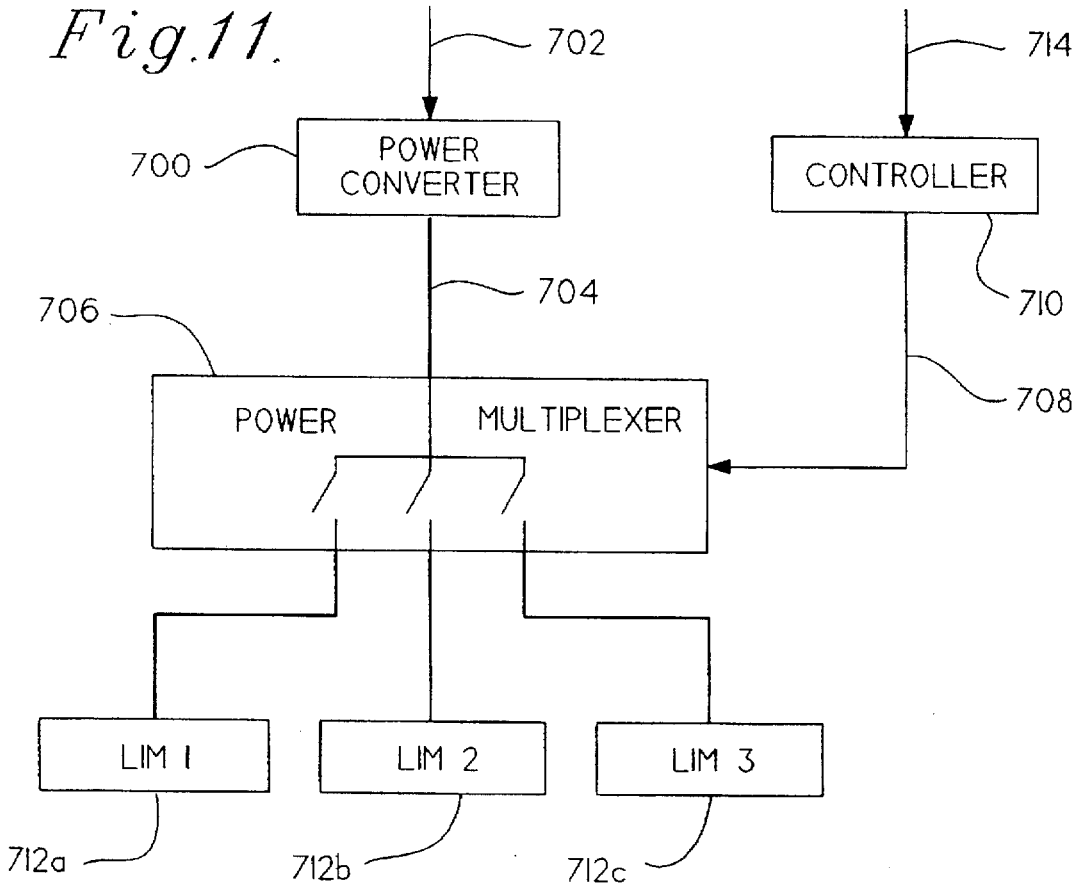
FIG. 11 is an illustration of one embodiment of power multiplexing according to the invention herein.

As indicated in FIGS. 7 and 9, and the discussion pertaining thereto, each linear induction stator may be provided with a dedicated power converter, controller and sensor. However, to reduce the complexity, expense and upkeep on linear induction retarders, power multiplexing can be provided, as shown in FIG. 11. In general, electric power 702 delivered to power converter 700 is converted therein to the desired voltage and frequency. This converted power 704 is delivered to power multiplexer 706. Responsive to control signal 708 from controller 710, power is directed by power multiplexer 706 to a preselected one or ones of linear induction stators 712*a*, 712*b*, or 712*c*. Controller 710 can be directed to divert electric power to linear induction stator 712*a*, 712*b*, 712*c* responsive to remote signal 714 which may be provided by a central yard facility.

Figure 12:
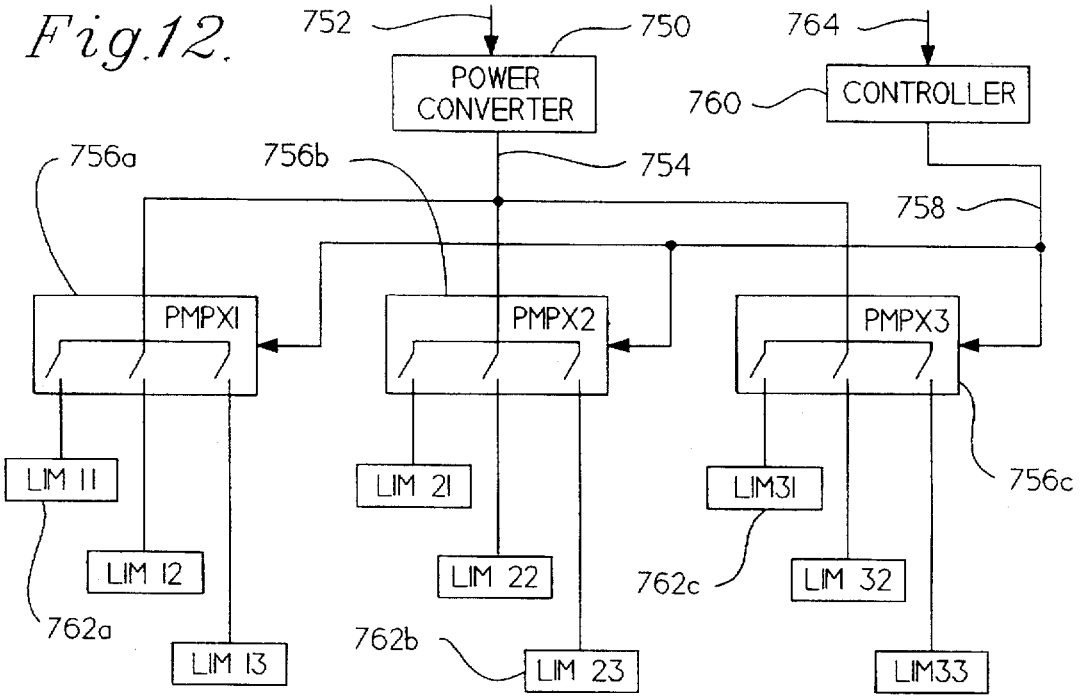
FIG. 12 is an illustration of another embodiment of power multiplexing according to the invention herein.

Power multiplexing may also be accomplished as depicted in FIG. 12. In general, electric power 752 delivered to power converter 750 is converted therein to the desired voltage and frequency. This converted power 754 is delivered to a plurality of power multiplexers 756*a*, 756*b*, 756*c*. Responsive to control signal 758 from controller 760, power is directed by one of power multiplexers 756*a*, 756*b*, 756*c* to a preselected one or ones of linear induction stators such as, for example, linear induction stators 762*a*, 762*b*, or 762*c*. Controller 760 can be directed to divert electric power to linear induction stator 762*a*, 762*b*, 762*c* responsive to remote signal 764 which may be provided by a central yard facility.

Figure 13:
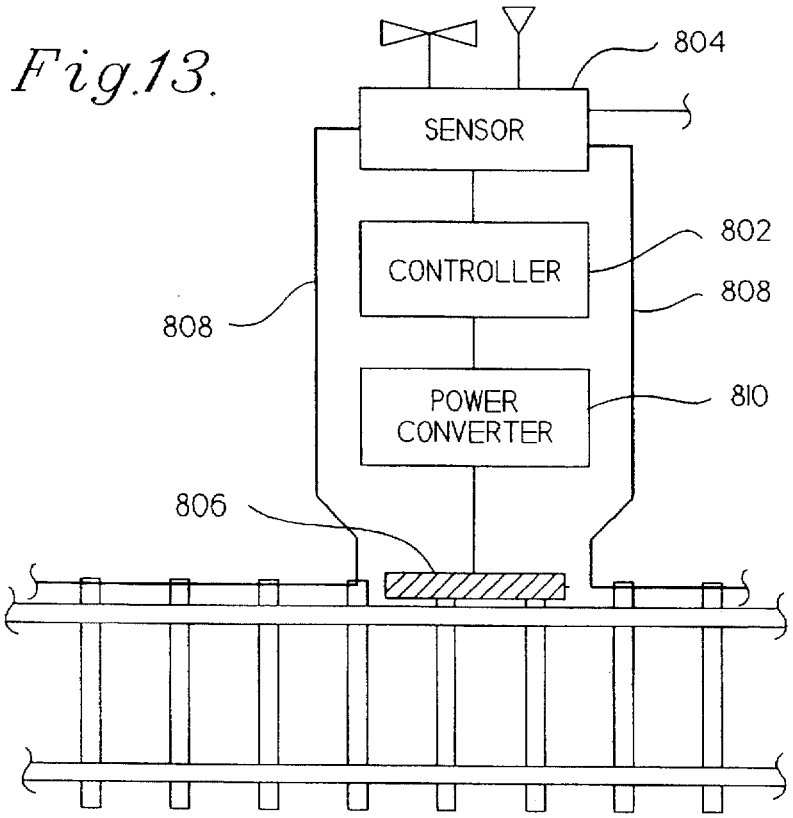
FIG. 13 is an illustration of a controller for controlling linear induction retarder mechanisms according to the invention herein.

Control of the retarders can be provided by controller 802, as shown in FIG. 13. Controller 802 can be influenced by sensor 804 to determine the precise voltage and frequency to supply to the retarder 806 by controlling the operation of power converter 810, thereby regulating railcar speed. Controller 802 can compute the requisite voltage and frequency from multiple input signals from sensor 804 such as, for example, distance-to-go, desired coupling velocity, railcar weight, railcar position, velocity, acceleration, weather conditions including wind, entry speed, and exit speed to produce as an output the desired force set point which may ultimately achieve the desired coupling velocity. Sensor 804 can include a fiber optic sensor 808 which may be distributed along a preselected section of track rail to determine the railcar weight, distance-to-go, railcar position, and railcar velocity. Fiber optic sensor 808 may be such as shown in co-pending application, Serial No. 08/370,497, filed Jan. 9, 1995, now abandoned assigned to the same assignor as the present application.

Figure 14:
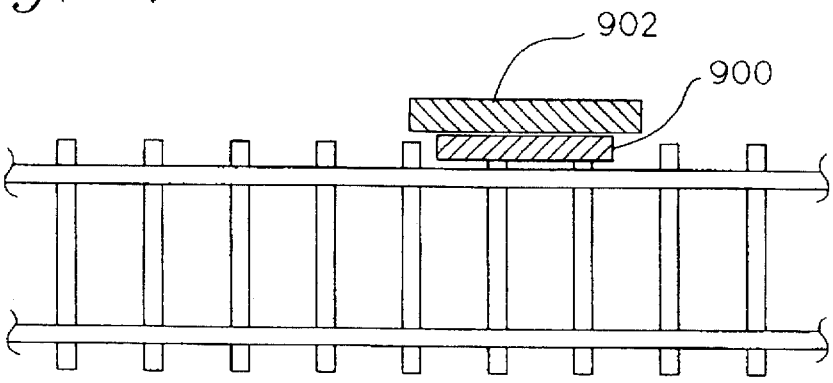
FIG. 14 is an illustration of a means for cooling linear induction stators.

Under certain conditions, it may be desirable to remove accumulated heat, which may be substantial, from linear induction stators, as illustrated in FIG. 14. Means for cooling 902 acts to remove excessive heat from the primary inductors of stator 900. The medium of cooling can be a fluid such as, for example, air, water, alcohol, or a compressed gas.

While certain presently preferred embodiments of the invention have been illustrated, it is understood that the invention is not limited thereto by may be otherwise variously embodied and practiced within the scope of the following claims.

We claim:

1. A railway car retarder system for controlling railcar speed, said system comprising:

(a) a plurality of linear induction stators each having a plurality of primary inductors, each of said plurality of linear induction stators having respective ones of said plurality of primary inductors magnetically linked to respective others of said plurality of primary inductors, respective pairs of said plurality of primary inductors having at least a portion of track rail disposed therebetween, said respective pairs imparting a magnetomotive force upon selected ones of a plurality of wheel sets, and at least three of said spaced plurality of primary inductors being disposed on at least one side of said track rail;

(b) a controllable power source electrically connected with, and providing electric current to, said plurality of linear induction stators, and said controllable power source being supplied electric current by a three-phase AC power supply;

(c) a controller, connected with said controllable power source, for selectively controlling said electric current to respective linear induction stators thereby controlling said magnetomotive force being imparted upon said selected ones of such plurality of wheel sets; and (d) a sensor for sensing selected railcar parameters and transmitting said parameters to said controller, and said sensor being operably connected with said controller.

2. The railway car retarder system of claim 1 wherein pole faces of second respective ones of said plurality of primary inductors of each of said linear induction stators are generally perpendicular to a longitudinal axis of said at least a portion of track rail, each of said pole faces is in confronting relation with said at least a portion of track rail, and said at least a portion of track rail is generally disposed between respective ones of said pole faces.

3. The railway car retarder system of claim 1 wherein (a) said respective ones of said plurality of primary inductors of each of said linear induction stators are magnetically linked to said respective others of said plurality of primary inductors by at least a portion of magnetically permeable substrate;

(b) said at least a portion of track rail is disposed generally above said plurality of inductors and said substrate, and said at least a portion of track rail is magnetically linked to at least a portion of said substrate;

(c) said at least a portion of track rail has a plurality of magnetic track sections and a plurality of non-magnetic track sections, first respective ones of said plurality of non-magnetic track sections are interposed between first respective ones of said plurality of magnetic sections, second respective ones of said non-magnetic track sections are disposed generally above second respective ones of said plurality of primary inductors, and second respective ones of said magnetic track sections are disposed generally above at least a portion of said substrate; and (d) respective pole faces of said plurality of primary inductors are generally coplanar with the diameter of one wheel of said plurality of wheel sets and colinear with said at least a portion of track rail.

4. The railway car retarder system of claim 1 wherein said sensor further includes a fiber optic sensor for sensing at least one of said selected railcar parameters.

5. The railway car retarder system of claim 1 wherein said controllable power source further comprises:

(a) a power multiplexer connected with selected ones of said plurality of linear induction stators; and (b) a power converter connected between a power supply and said power multiplexer.

6. The railway car retarder system of claim 5 wherein said power converter is a variable-voltage variable-frequency converter.

7. The railway car retarder system of claim 1 wherein respective ones of said plurality of linear induction stators is disposed on one lateral side of a wheel of said selected ones of such plurality of wheel sets.

8. The railway car retarder system of claim 1 wherein respective ones of said plurality of linear induction stators are disposed on both lateral sides of a wheel of said selected ones of such plurality of wheel sets.

9. The railway car retarder system of claim 1 wherein respective ones of said plurality of linear induction stators are disposed on both lateral sides of both wheels of said selected ones of such plurality of wheel sets.

10. A railway car retarder system for controlling railcar speed, said system comprising:

(a) a first plurality of linear induction stators each having a spaced plurality of primary inductors, each of said first plurality of linear induction stators having respective ones of said plurality of primary inductors being magnetically linked to respective others of said plurality of primary inductors, respective pairs of said plurality of primary inductors having at least a portion of track rail disposed therebetween, and said respective pairs imparting a magnetomotive force upon selected ones of a plurality of wheel sets;

(b) a plurality of controllable power sources each electrically connected with, and providing electric current to, a second plurality of linear induction stators;

(c) a controller, connected with said plurality of controllable power sources, for selectively controlling said electric current to respective ones of said plurality of linear induction stators, thereby controlling said magnetomotive force being imparted upon said selected ones of such plurality of wheel sets; and (d) a sensor for sensing selected railcar parameters and transmitting said parameters to said controller, and said sensor being operably connected with said controller.

11. The railway car retarder system of claim 10 wherein pole faces of each of said plurality of primary inductors is generally perpendicular to a longitudinal axis of said at least a portion of track rail, each of said pole faces is in confronting relation with said at least a portion of track rail, and said at least a portion of track rail is disposed generally between respective ones of said pole faces.

12. The railway car retarder system of claim 10 wherein (a) said respective ones of said plurality of primary inductors are magnetically linked to said respective others of said plurality of primary inductors by at least a portion of magnetically permeable substrate;

(b) said at least a portion of track rail is disposed generally above said plurality of inductors and said substrate, and said at least a portion of track rail is magnetically linked to at least a portion of said substrate;

(c) said at least a portion of track rail has a plurality of magnetic track sections and a plurality of non-magnetic track sections, first respective ones of said plurality of non-magnetic track sections are interposed between first respective ones of said plurality of magnetic sections, second respective ones of said non-magnetic track sections are disposed generally above second respective ones of said plurality of primary inductors, and second respective ones of said magnetic track sections are disposed generally above at least a portion of said substrate; and (d) respective pole faces of said plurality of primary inductors are generally coplanar with the diameter of one wheel of said plurality of wheel sets and colinear with said at least a portion of track rail.

13. The railway car retarder system of claim 10 wherein said sensor further includes a fiber optic sensor for sensing at least one of said selected railcar parameters.

14. The railway car retarder system of claim 10 wherein each of said plurality of controllable power sources further comprises:

(a) a power multiplexer connected with said second plurality of linear induction stators; and (b) a power converter connected between a power supply and said power multiplexer.

15. The railway car retarder system of claim 14 wherein said power converter is a variable-voltage variable-frequency converter.

16. The railway car retarder system of claim 10 wherein respective ones of said first plurality of linear induction stators is disposed on one lateral side of a wheel of said selected ones of such plurality of wheel sets.

17. The railway car retarder system of claim 10 wherein respective ones of said first plurality of linear induction stators are disposed on both lateral sides of a wheel of said selected ones of such plurality of wheel sets.

18. The railway car retarder system of claim 10 wherein respective ones of said first plurality of linear induction stators are disposed on both lateral sides of both wheels of said selected ones of such plurality of wheel sets.

19. A railway car retarder system for controlling railcar speed, said system comprising:

(a) a plurality of linear induction stators each having a spaced plurality of primary inductors, each of said plurality of linear induction stators having respective ones of said plurality of primary inductors being magnetically linked to respective others of said plurality of primary inductors, respective pairs of said plurality of primary inductors having at least a portion of track rail disposed therebetween, and said respective pairs imparting a magnetomotive force upon selected ones of a plurality of wheel sets;

(b) a plurality of controllable power sources each electrically connected with, and providing electric current to, a respective one of said plurality of linear induction stators;

(c) a controller, connected with said plurality of controllable power sources, for selectively controlling said electric current to respective linear induction stators, thereby controlling said magnetomotive force being imparted upon said selected ones of such plurality of wheel sets; and (d) a sensor for sensing selected railcar parameters and transmitting said parameters to said controller, and said sensor being operably connected with said controller.

20. The railway car retarder system of claim 19 wherein pole faces of said plurality of primary inductors are generally perpendicular to a longitudinal axis of said at least a portion of track rail, each of said pole faces is in confronting relation with said at least a portion of track rail, and said at least a portion of track rail is generally disposed between respective ones of said pole faces.

21. The railway car retarder system of claim 19 wherein (a) said respective ones of said plurality of primary inductors of each of said linear induction stators are magnetically linked to said respective others of said plurality of primary inductors by at least a portion of magnetically permeable substrate;

(b) said at least a portion of track rail is disposed generally above said plurality of inductors and said substrate, and said at least a portion of said track rail is magnetically linked to at least a portion of said substrate;

(c) said at least a portion of track rail has a plurality of magnetic track sections and a plurality of non-magnetic track sections, first respective ones of said plurality of non-magnetic track sections are interposed between first respective ones of said plurality of magnetic sections, second respective ones of said non-magnetic track sections are disposed generally above second respective ones of said plurality of primary inductors, and second respective ones of said magnetic track sections are disposed generally above at least a portion of said substrate; and (d) respective pole faces of said plurality of primary inductors are generally coplanar with the diameter of one wheel of said plurality of wheel sets and colinear with said at least a portion of track rail.

22. The railway car retarder system of claim 19 wherein said sensor further includes a fiber optic sensor for sensing at least one of said selected railcar parameters.

23. The railway car retarder system of claim 19 wherein each of said plurality of controllable power sources further comprises:

(a) a power multiplexer connected with said respective one of said plurality of linear induction stators; and (b) a power converter connected between a power supply and said power multiplexer.

24. The railway car retarder system of claim 23 wherein said power converter is a variable-voltage variable-frequency converter.

25. The railway car retarder system of claim 19 wherein respective ones of said plurality of linear induction stators is disposed on one lateral side of a wheel of said selected ones of such plurality of wheel sets.

26. The railway car retarder system of claim 19 wherein respective ones of said plurality of linear induction stators are disposed on both sides of a wheel of said selected ones of such plurality of wheel sets.

27. The railway car retarder system of claim 19 wherein respective ones of said plurality of linear induction stators are disposed on both sides of both wheels of said selected ones of such plurality of wheel sets.

28. A railway car retarder system for controlling railcar speed, said system comprising:

(a) a linear induction stator having a spaced plurality of primary inductors, respective pairs of said plurality of primary inductors having at least a portion of track rail disposed therebetween, said respective pairs imparting a magnetomotive force upon selected ones of a plurality of wheel sets, said respective ones of said plurality of primary inductors being magnetically linked to said respective others of said plurality of primary inductors by at least a portion of magnetically permeable substrate, said at least a portion of track rail being disposed generally above said plurality of inductors and said substrate, said at least a portion of track rail being magnetically linked to at least a portion of said substrate, said at least a portion of track rail having a plurality of magnetic track sections and a plurality of non-magnetic track sections, first respective ones of said plurality of non-magnetic track sections being interposed between first respective ones of said plurality of magnetic sections, second respective ones of said non-magnetic track sections being disposed generally above second respective ones of said plurality of primary inductors, second respective ones of said magnetic track sections being disposed generally above at least a portion of said substrate, and respective pole faces of said plurality of primary inductors being generally coplanar with the diameter of one wheel of said plurality of wheel sets and colinear with said at least a portion of track rail;

(b) a controllable power source electrically connected with, and providing electric current to, said linear induction stator;

(c) a controller, connected to said controllable power source, for selectively controlling said electric current to said primary inductors, thereby controlling said magnetomotive force being imparted upon said selected ones of such plurality of wheel sets; and (d) a sensor for sensing selected railcar parameters and transmitting said parameters to said controller, and said sensor being operably connected with said controller.

29. The railway car retarder system of claim 28 wherein said sensor further includes a fiber optic sensor for sensing at least one of said selected railcar parameters.

30. The railway car retarder system of claim 28 wherein said power converter is a variable-voltage variable-frequency converter.

31. The railway car retarder system of claim 30 wherein said controllable power source further comprises a power converter connected between a power supply and said linear induction stators.

32. A railway car retarder system for controlling railcar speed, said system comprising:

(a) a linear induction stator having a spaced plurality of primary inductors, respective ones of said plurality of primary inductors being magnetically linked to respective others of said plurality of primary inductors, respective pairs of said plurality of primary inductors having at least a portion of track rail disposed therebetween, said respective pairs imparting a magnetomotive force upon selected ones of a plurality of wheel sets, pole faces of said plurality of primary inductors are generally perpendicular to a longitudinal axis of said at least a portion of track rail, each of said pole faces is in confronting relation with said at least a portion of track rail, said at least a portion of track rail is generally disposed between respective ones of said pole faces, and at least three of said spaced plurality of primary inductors being disposed on at least one lateral side of a wheel;

(b) a controllable power source electrically connected with, and providing electric current to, said linear induction stator, and said controllable power source being supplied electric current by a three-phase AC power supply;

(c) a controller, connected with said controllable power source, for selectively controlling said electric current to said primary inductors, thereby controlling said magnetomotive force being imparted upon said selected ones of such plurality of wheel sets; and (d) a sensor for sensing selected railcar parameters and transmitting said parameters to said controller, and said sensor being operably connected with said controller.

33. The railway car retarder system of claim 32 wherein said sensor further includes a fiber optic sensor for sensing at least one of said selected railcar parameters.

34. The railway car retarder system of claim 32 wherein said power converter is a variable-voltage variable-frequency converter.

35. The railway car retarder system of claim 34 wherein said controllable power source further comprises a power converter connected between a power supply and said linear induction stator.

36. The railway car retarder system of claim 32 wherein said linear induction stator is disposed on one lateral side of a wheel of said selected ones of such plurality of wheel sets.

37. The railway car retarder system of claim 32 wherein said linear induction stator is disposed on both lateral sides of a wheel of said selected ones of such plurality of wheel sets.

38. The railway car retarder system of claim 32 wherein said linear induction stator is disposed on both lateral sides of both wheels of said selected ones of such plurality of wheel sets.

* * * * *